US005327984A

United States Patent [19].

Rasi et al.

[11] Patent Number: 5,327,984

[45] Date of Patent: Jul. 12, 1994

[54] METHOD OF CONTROLLING CUTTINGS ACCUMULATION IN HIGH-ANGLE WELLS

[75] Inventors: Marco Rasi, Houston; Eugene A. Sikirica, Katy, both of Tex.

[73] Assignee: Exxon Production Research Company, Houston, Tex.

[21] Appl. No.: 32,808

[22] Filed: Mar. 17, 1993

[51] Int. Cl.[5] ..... E21B 7/00

[52] U.S. Cl. ..... 175/61

[58] Field of Search ..... 175/57, 61, 65, 70

[56] References Cited

U.S. PATENT DOCUMENTS

| | | | |
|---|---|---|---|
| 2,043,504 | 6/1936 | Blow | 175/70 |
| 2,252,669 | 8/1941 | Cross et al. | 175/70 |
| 3,040,822 | 6/1962 | Graham et al. | 175/70 |
| 3,461,980 | 8/1969 | Kelley, Jr. | 175/70 |
| 3,762,485 | 10/1973 | Chesser | 175/65 |
| 4,298,078 | 3/1981 | Lawrence . | |
| 4,423,791 | 1/1984 | Moses, Jr. | 175/65 |
| 4,473,124 | 9/1984 | Savins . | |
| 4,491,181 | 1/1985 | Krol . | |
| 4,496,012 | 1/1985 | Savins . | |
| 4,643,264 | 2/1987 | Dellinger . | |
| 4,646,855 | 3/1987 | Dellinger . | |
| 4,791,998 | 12/1988 | Hempkins et al. . | |
| 4,890,682 | 1/1990 | Worrall et al. . | |

OTHER PUBLICATIONS

Dodge, D. W. and A. B. Metzer, "Turbulent Flow of Non-Newtonian Systems," *A.I.Ch.E. Journal*, vol. 5, No. 2, pp. 189-204.

Ford, J. T. et al., "Experimental Investigation of Drilled Cuttings Transport in Inclined Boreholes," *Society of Petroleum Engr. SPE* 20421, presented to SPE 65th Annual Technical Conference in New Orleans, LA, Sep. 23-26, 1990, pp. 197-206.

Henderson, *Open Channel Flow*, MacMillan Series of Civil Engineering, pp. 92-94, 412-413.

Lohrenz, John and Fred Kurata, "A Friction Factor Plot," *Industrial and Engineering Chemistry*, vol. 52, No. 8, Aug. 1960, pp. 703-706.

Okrajni, S. S. and J. J. Azar, "Mud Cuttings Transport in Directional Well Drilling," *Society of Petroleum Engr. SPE* 14178, presented at the SPE 60th Annual Technical Conference in Las Vegas, NV, Sep. 22-25, 1985.

Sifferman, T. R. and T. E. Becker, "Hole Cleaning in Full-Scale Inclined Wellbores," *Society of Petroleum Engr. SPE* 20422, presented at the SPE 65th Annual Technical Conference in New Orleans, LA, Sep. 23-26, 1990.

Streeter, V. L., *Handbook of Fluid Dynamics*, McGraw-Hill Book Co., Inc. 1961, pp. 3-10-3-13.

R. E. Walker and T. M. Mayes, "Design of Muds for Carrying Capacity," *Journal of Petroleum Technology*, Jul. 1975, pp. 893-900.

*Primary Examiner*—Ramon S. Britts
*Assistant Examiner*—Frank S. Tsay
*Attorney, Agent, or Firm*—Pravel, Hewitt, Kimball & Krieger

[57] ABSTRACT

A method is provided, based on assigned drilling variables, for predicting the area of open region above a bed of cuttings resulting from drilling a high-angle well. The area of the bit used in drilling is compared with the area of the open region and drill pipe to determine a Hole-Cleaning Ratio. Occurrences of sticking of drill pipe or other drilling problems in prior-drilled wells are correlated with Hole Cleaning Ratio in those wells to determine a relationship for predicting risk of drilling problems in wells of interest. Risk factors so determined are used to modify conditions or equipment during drilling or to plan future wells.

12 Claims, 10 Drawing Sheets

FIG. 6a
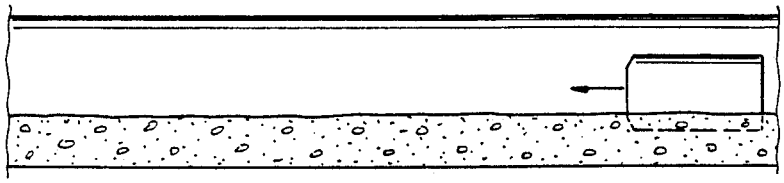
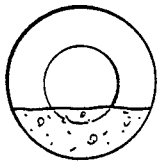
FIG. 6b
FIG. 6c
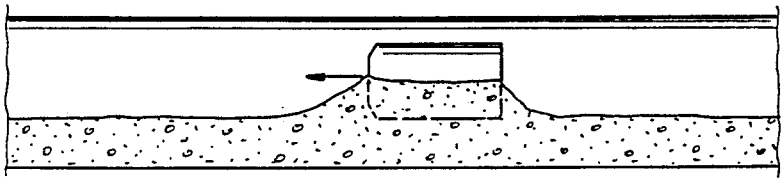
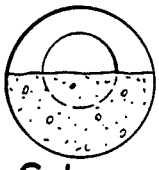
FIG. 6d
FIG. 6e
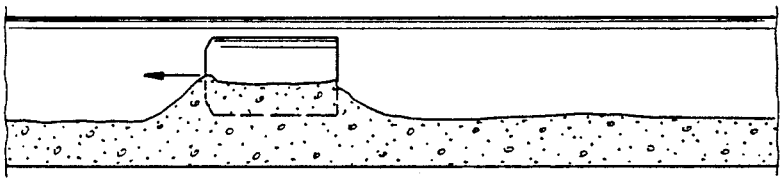
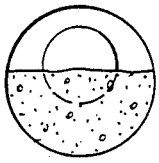
FIG. 6f
FIG. 7a
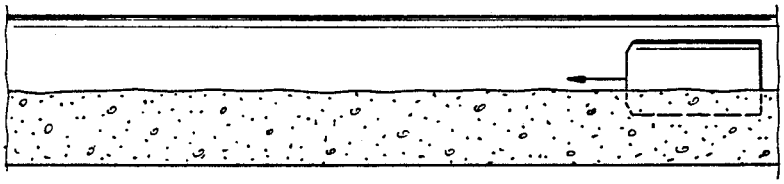
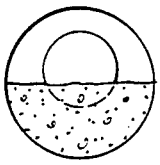
FIG. 7b
FIG. 7c
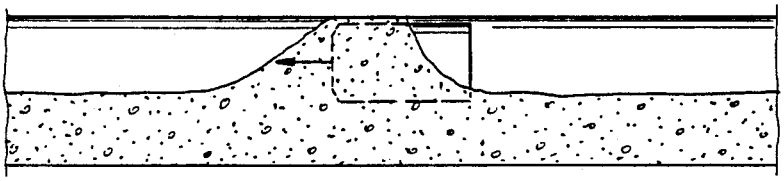
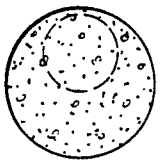
FIG. 7d
FIG. 7e
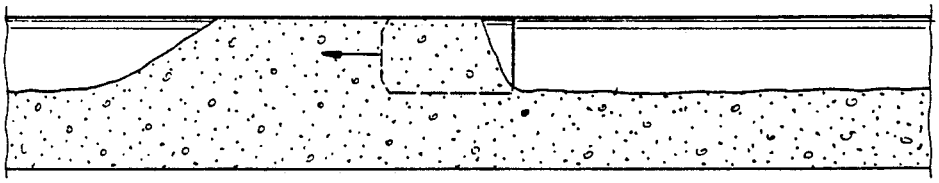

METHOD OF CONTROLLING CUTTINGS ACCUMULATION IN HIGH-ANGLE WELLS

BACKGROUND OF THE INVENTION

1. Field of the Invention

This invention relates to the drilling or boring of wells in the earth. More specifically, a method is provided for analyzing and controlling the effects of accumulation of cuttings in the wellbore when drilling at an angle greater than about 50 degrees to vertical.

2. Description of Related Art

The process of boring or drilling in the earth produces particles of rock which must be removed from the borehole. One of the functions of the drilling fluid used in the drilling process is to carry these "cuttings" from the bit where they are created to the surface of the earth. In vertical or near-vertical wells, the drilling fluid is normally formulated to have viscosity high enough to decrease the settling velocity of cuttings to a value much less than the upward velocity of drilling fluid in the hole, so the cuttings will be efficiently carried from the well. Gel strength of the fluid is also normally formulated to prevent rapid fall of cuttings in the wellbore when fluid circulation is interrupted.

In recent years, there has been a major upswing in the drilling of wells in directions other than vertical. "High-angle" wells are drilled for hydrocarbon production from platforms constructed offshore and from pads built in the arctic. "Horizontal wells," a sub-class of high-angle wells, are drilled at angles near 90 degrees to vertical for a variety of reasons related to hydrocarbon production; they may also be drilled for environmental remediation and other purposes. Some high-angle wells may terminate at a location displaced thousands of feet horizontally from the surface location of the well. There is a very large economic incentive at times to push this horizontal displacement to the maximum distance achievable so that additional hydrocarbons can be recovered from existing surface facilities.

It has been recognized for many years that removal of the cuttings from the wellbore during drilling of high-angle wells poses a special problem. When the cuttings settle by force of gravity to the bottom of the hole, a "bed" of solids is formed along the bottom of the hole. The bed can become especially significant in larger size holes, where fluid velocities are lower. Experience from drilling high-angle wells shows that pipe sticking and related drilling problems are especially frequent in the larger holes (17½-inch and 12¼-inch holes) drilled at angles above about 40–50 degrees.

Build-up of a bed of cuttings in the high-angle portion of wellbores, or, stated another way, failure to achieve sufficient "hole cleaning," can cause several types of problems. One problem at times may be that the amount of torque required to rotate the drill string increases to limit the ability to drill the well to the target location. Another is that there is difficulty in withdrawing and placing the drill string in the well. In the most unfavorable scenario, the amount of pull required to withdraw the drill string from the well increases to the point that the pipe is stuck in the well. This condition can be very expensive to remedy. A single stuck pipe incident may cost over one million dollars. It is estimated that stuck pipe costs in industry are in the range from 100 to 500 million dollars per year. In attempts to avoid such problems from insufficient hole-cleaning, drilling operators often include such maneuvers as "washing and reaming," wherein the drilling fluid is circulated and the drill string is rotated as the bit is introduced into the wellbore, and "backreaming," wherein the drilling fluid is circulated and the drill string is rotated as the bit is withdrawn from the wellbore. Other operations such as "wiper trips" or "pumping out of the hole" are performed to attempt to control the amount of cuttings accumulated in the wellbore. All these operations require time and can very significantly add to the cost of drilling a high-angle well.

In addition to excessive forces on the drill string, solids accumulation in the wellbore can also cause interference with running casing in the hole after drilling is complete and can cause excessive circulation pressures leading to loss of drilling fluid from the well bore.

Several studies in university and industry laboratories in recent years have been directed to hole-cleaning in high-angle wells. Recent reports have been published, for example, by J. T. Ford et al, SPE 20421, Society of Petroleum Engineers (Richardson, Tex.), 1990, and by T. R. Sifferman and T. E. Becker, SPE 20422, Society of Petroleum Engineers, 1990. There is no general agreement among investigators, however, on the factors which will cause bed height of cuttings in a high-angle well to increase or decrease. No methods are known that calculate the correct height of the bed of cuttings in a high-angle well.

U.S. Pat. No. 4,791,998 is directed to a method of avoiding stuck drilling equipment. The method is based on a statistical analysis of drilling variables in wells drilled in the same area, comparing wells in which sticking was experienced and not experienced, and modifying variables in a drilling well toward those conditions which the mathematical analysis indicates will not cause sticking.

There is a long-felt need for a method to select the most cost-effective values of drilling variables and conditions to drill a high-angle well where cuttings may accumulate in the wellbore. This method should allow a prediction of the height of a bed of cuttings in a well as drilling variables are adjusted. The method should consider, along with bed height, the size and configuration of drilling equipment in the hole and their effect on the likelihood of sticking the drill string in the hole. Such method is needed for planning the material and equipment which will be provided to drill a well and to adjust drilling variables while the well is being drilled. The method should be susceptible to further refinement by hindcasting drilling data from wells previously drilled to determine the relationship between well conditions and frequency of drilling problems. With such relationship, the risk of encountering drilling problems can be assessed and, when necessary, reduced with increasing confidence in wells of interest.

SUMMARY OF THE INVENTION

The present invention is properly viewed as a method for well-drilling analysis and control for high-angle wells. A method for predicting the height of a bed of cuttings in a wellbore is provided. Further, a method of selecting conditions to avoid sticking the drill string in a well from accumulation of drilled cuttings is provided. The method includes a calculation of the open area above the cuttings bed and a comparison of this area plus the area of the drill pipe to the measured solid cross-sectional area of the bit used in the drilling. Also provided is a method for assessing risks of drilling problems. Such methods may be used to plan the drilling of a well by assigning a range of values to physical variables and calculating the depth of a bed of cuttings which would occur in the well and comparing the calculated depth to a predetermined level. Further, a method is provided for calculating height of a cuttings bed and adjusting drilling variables during the drilling of a well. Hindcasts are used to establish a relationship between the predicted height of a cuttings bed in prior-drilled wells, the size of equipment in the wells and the frequency of occurrence of drilling problems in the wells. Such relationship is applied to drilling of current or future wells to minimize costs.

BRIEF DESCRIPTION OF THE DRAWINGS

FIG. 6(*a*), (*b*), (*c*), (*d*), (*e*) and (*f*) are a sketch of a simulated bit on a drill string moving over a bed of cuttings which does not cause sticking.

FIG. 7(*a*), (*b*), (*c*), (*d*) and (*e*) are a sketch of a simulated bit on a drill string moving over a high bed of cuttings which causes sticking.

DESCRIPTION OF PREFERRED EMBODIMENT

Figure 1:
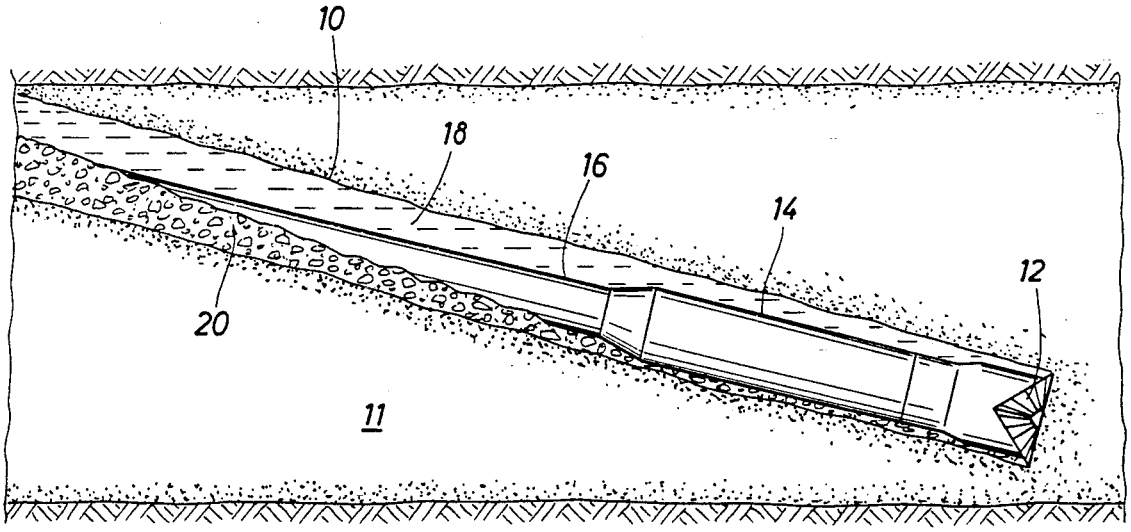
FIG. 1 shows a high-angle wellbore being drilled by a bit on a drill string.

Referring to FIG. 1, wellbore 10 of a high-angle well has been formed in subsurface formation 11. Bit 12 is joined to the drill string consisting of drill collars 14 and drill pipe 16. Drilling fluid 18 is circulating down drill pipe 16 and up the annulus outside the drill pipe. Drilling fluid 18 has transported cuttings formed in the drilling process to form cuttings bed 20 lying at the bottom of wellbore 10. The diameter of wellbore 10 is usually equal to the largest diameter of bit 12.

Figure 2:
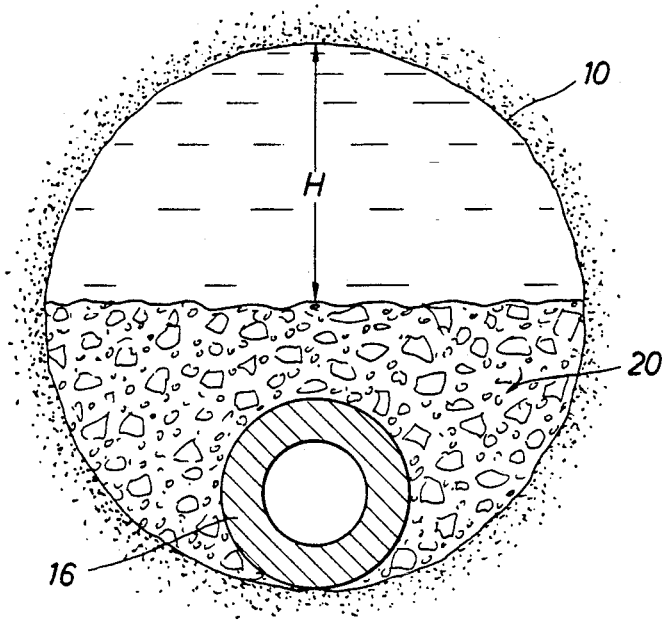
FIG. 2 shows a cross-section of a wellbore with a cuttings bed and drill pipe therein.

FIG. 2 shows wellbore 10 in cross-section. Drill pipe 16 is resting on the bottom of wellbore 10. The method of this invention is less applicable where drill pipe 16 is not substantially covered by cuttings bed 20. The method is not applicable where drill pipe 16 is not covered to at least ⅓ of its diameter by cuttings bed 20. Because of the common size of drill pipe, the size of drilled hole must be greater than about 8½-inches according to the method of this invention. The distance, H, across the open area above the cuttings bed is determined by the steps described below.

We have discovered that the distance H can be calculated, by proper combination of physical variables, and the value of H so determined explains measurements and experiences observed in the drilling of high-angle wells. We have also discovered that the open cross-sectional area above the bed of cuttings plus the area of the drill pipe, when compared to the area of the drill bit in the hole, can be used to predict whether the drill string will become stuck when pulling the drill string from a well.

The following paragraphs describe how H is calculated, show the importance of H on the sticking of drill strings, and relate how integration of field measurements from wells already drilled provides a method of measuring risk of drilling problems.

Calculation of Bed Height or Distance Across the Open Area Above the Bed

The method of this invention includes calculating the equilibrium height of a bed of cuttings in the high-angle portion of a wellbore. The height of the bed is equal to the diameter of the wellbore less the distance across the open area above the bed. If the distance H of FIG. 2, which is defined as the distance across the open area above the bed, is greater than the equilibrium distance, cuttings will continue to deposit in the bed when fluid containing cuttings flows over the bed. If the distance H is less than the equilibrium distance, cuttings will be eroded from the surface of the bed by fluid flow over the surface of the bed. For the bed to be eroded, particles on the bed surface are lifted and dragged forward by the fluid. Therefore, the equilibrium distance will be determined by the flow conditions where bed erosion or deposition do not occur or where the rates of erosion and deposition are equal.

The conditions determining equilibrium bed height are a function of shear stress in the fluid flowing at the surface of the bed. Shear stress is determined by:

$$\tau = f \rho_f V^2/2, \qquad \text{(Eq. 1)}$$

where f is the well-known friction factor, $\rho_f$ is fluid density, and V is average cross-sectional velocity in the open region above the bed. Friction factor f will be determined by use of a friction factor correlation which is selected dependent on flow condition in the open region.

Referring now to FIGS. 3A–D, a flow chart for the program which may be executed by a computer to implement a preferred embodiment of the invention is shown. The program begins at step 500 with an initial value of H. Control proceeds to step 502 to calculate hydraulic radius of the open region=4*area for flow/wetted perimeter of the open region above the cuttings bed, as explained by the paper of Lohrenz and Kurata (Ind. and Engr. Chem., Vol 52, August, 1960), which is incorporated by reference herein. Control then proceeds to step 504 to calculate relative roughness of the bed surface, which is defined as being equal to ⅓ of cuttings size/hydraulic radius. Control then proceeds to step 506 to calculate the generalized Reynolds number for cross-sectional flow, as explained by Dodge and Metzner, A.I.Ch.E. Journal, Vol. 5, June, 1959, which is incorporated by reference herein.

Control is transferred to step 508 to determine, from equations representing curves in the Dodge and Metzner paper, the value of generalized Reynolds Number at the transitions from laminar to transition flow and from transition to turbulent flow, and the value of friction factors at these transitions.

Control is transferred to step 510 wherein the generalized Reynolds Number from step 506 is compared with the transition values from step 508 to determine whether the flow regime in the open region is laminar. If Yes, friction factor from the Dodge and Metzner curves (paper referenced above) is determined in step 512. Control is transferred to step 514 and this friction factor is used in Eq. 1 to calculate shear stress at the surface of the bed. Control is then transferred to step 562.

If No in step 510, control is transferred to step 516 to determine whether the flow regime is transition. If Yes, control is transferred to step 518, where an initial or trial value for the bed shear stress is supplied. Control is then transferred to step 520 to determine the friction factor from the Nikuradse curves (V. L. Streeter, *Handbook of Fluid Dynamics*, p. 3-11, McGraw-Hill Pub. Co., 1961, which is incorporated by reference) and at the generalized Reynolds number equal to the transition from transition flow to turbulent flow on the Dodge and Metzner curves at the appropriate value of n and at the appropriate value of the relative roughness of the bed surface where n is the exponent in the power-law model of the drilling fluid rheology. Call this value FNR.

The friction factor at the same generalized Reynolds number from the Dodge and Metzner curve is determined. Call this value FT.

The friction factor at the transition between laminar and transition flow is determined. Call this value FLT.

Control is transferred to step 521, and the parameter $$P = \frac{(d/3)V_* \rho_f}{\mu} \qquad \text{(Eq. 2)}$$

is calculated, where d is particle size, V, is shear velocity as obtained from bed shear stress, $\rho_f$ is fluid density and $\mu$ is fluid viscosity at the shear rate. The bed surface is called "hydrodynamically rough" if $P > 100$, "hydrodynamically smooth" if $P < 3$, and "in transition" if 323 $P \leqq 100$.

If the surface is hydrodynamically rough (Yes to step 522), control is transferred to step 524 to obtain the friction factor at the actual generalized Reynolds number by logarithmically interpolating between FLT and FNR. If the surface is not hydrodynamically rough (No to step 522), control is transferred to step 526. If the surface of the bed is hydrodynamically smooth (YES to step 526), control is transferred to step 528 to determine the friction factor obtained from the Dodge and Metzner curves at the appropriate n. If the flow is in transition, (i.e., neither hydrodynamically rough nor hydrodynamically smooth), control is transferred to step 530. The routine determines the friction factor by logarithmically interpolating between the friction factors that would be obtained if the bed surface were hydrodynamically smooth or rough.

Figure 3A:
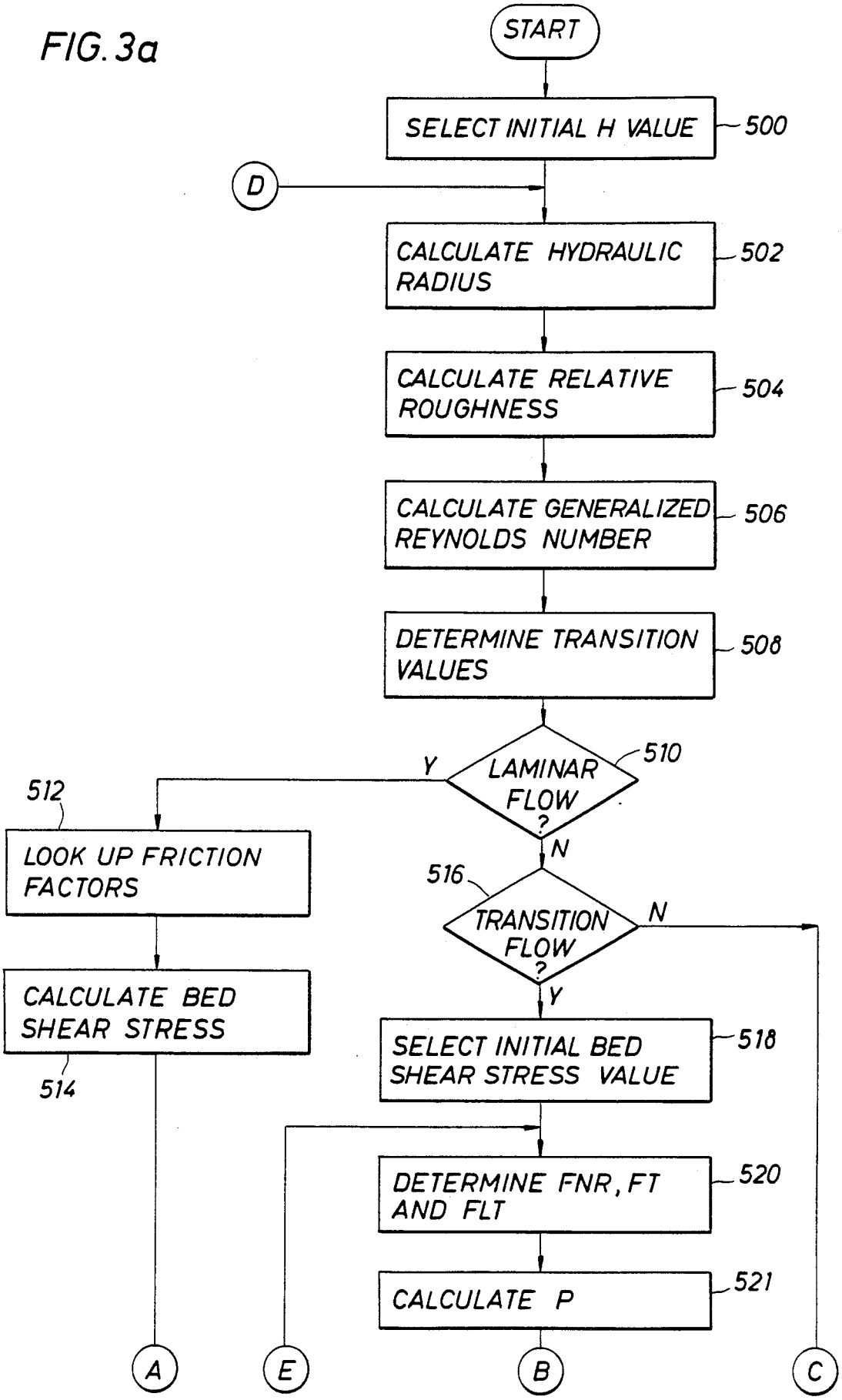
FIG. 3(*a*), (*b*), (*c*) and (*d*) are flow charts of a program to calculate the distance of an open region above a bed of cuttings in a wellbore.
Figure 3B:
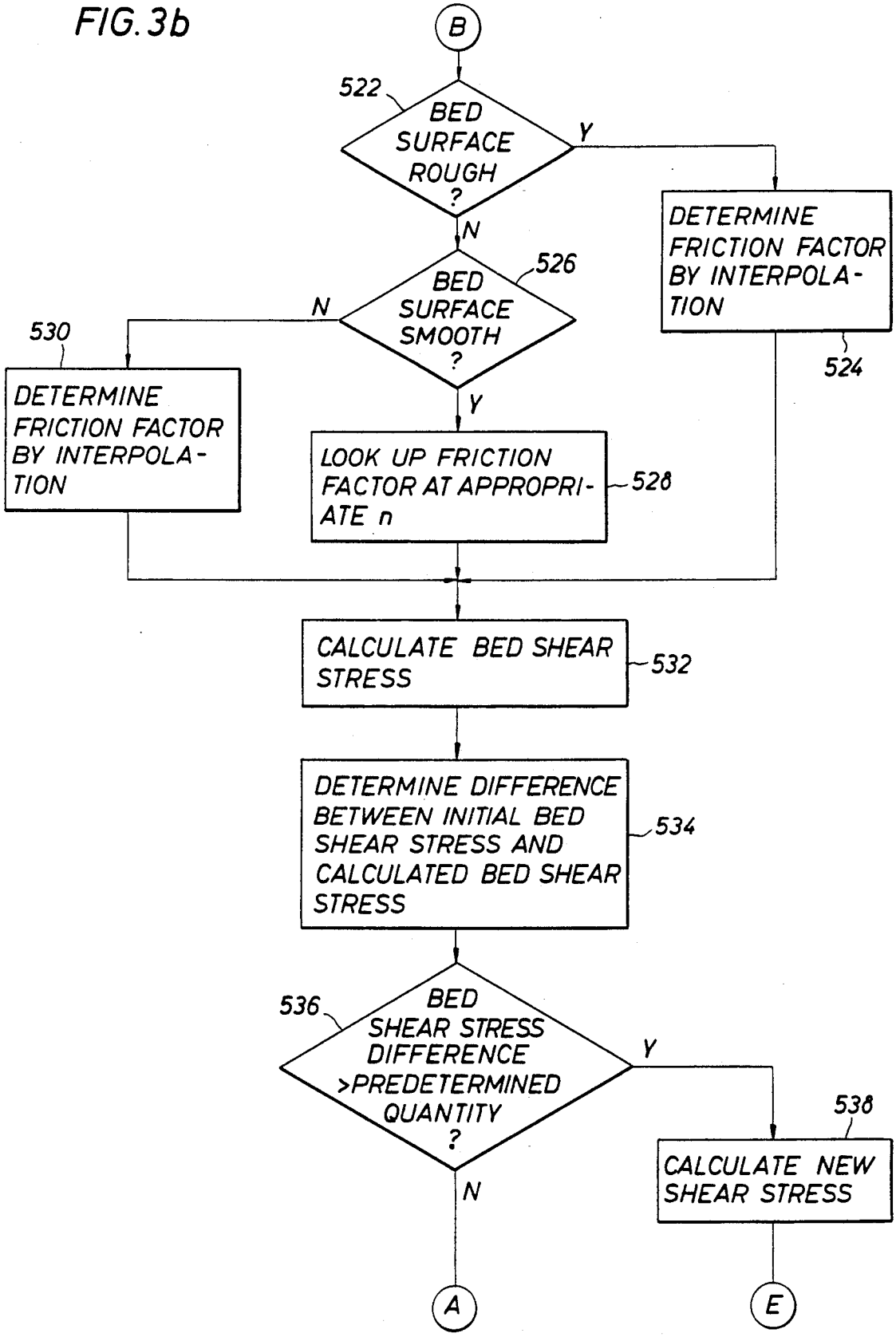
Figure 3C:
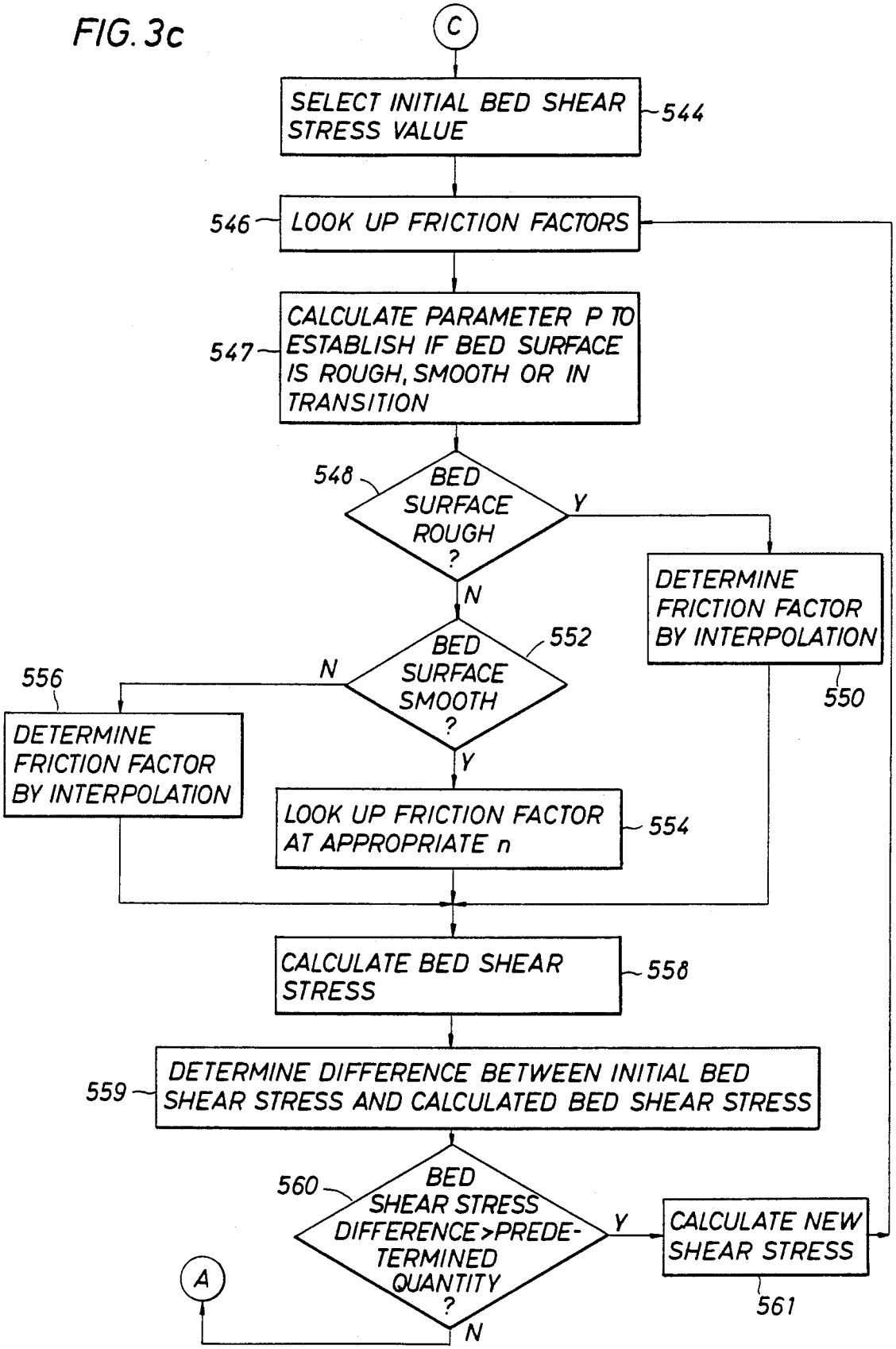
Figure 3D:
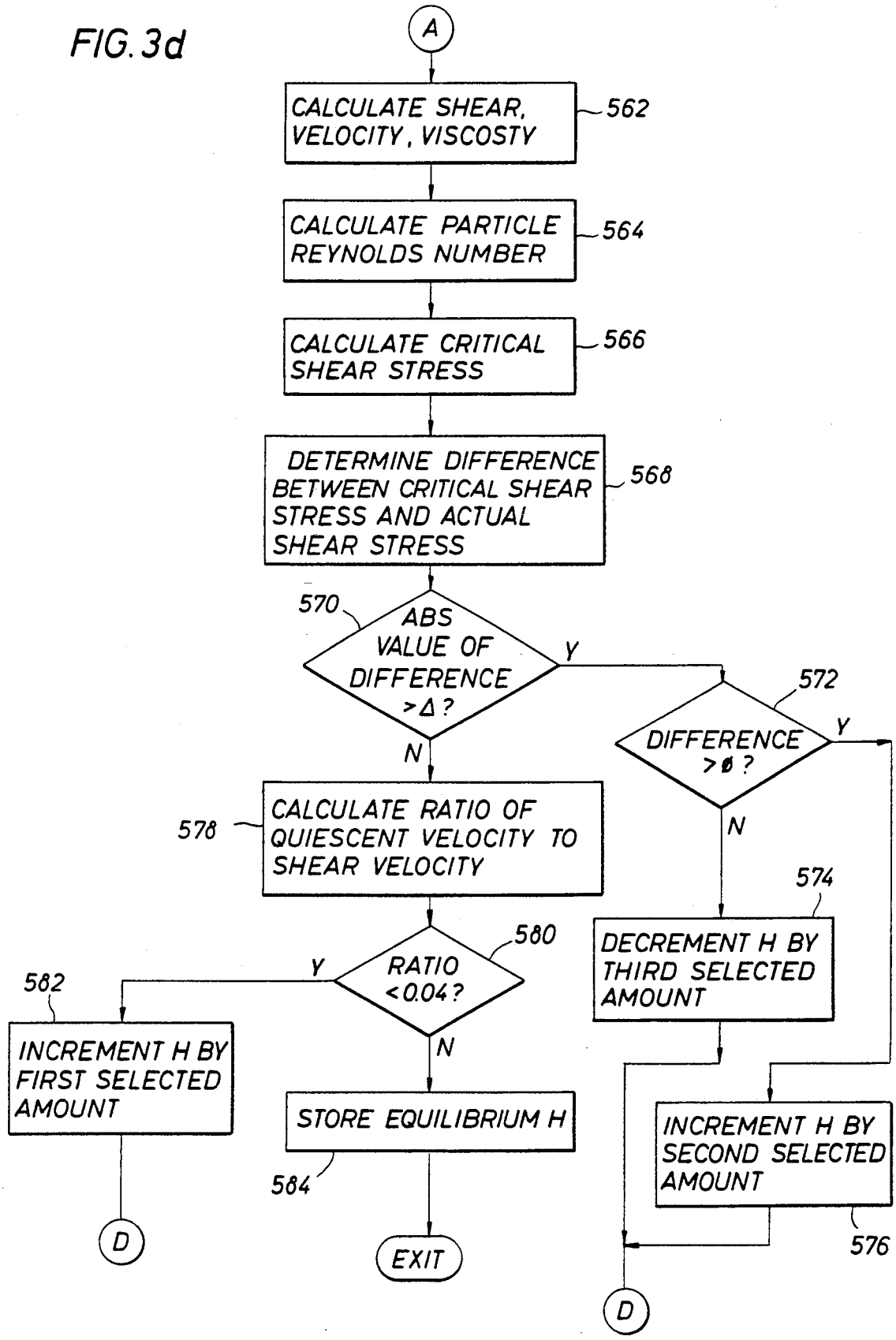

Control is transferred to step 532 to calculate the bed's shear stress using the friction factor and Equation 1. Control is transferred to step 534 to determine the difference between the initial shear stress of step 518 and the shear stress of step 532. Control is transferred to step 536 to determine if the calculated shear stress differs from the initial value tried by more than a fixed small number. If Yes, a new value of bed shear stress equal the arithmetic mean between the initial value and the new value is determined in step 538 and control is returned to step 520. If No, control is transferred to step 562 (FIG. 3D).

If No in step 516, control is transferred to step 544 (FIG. 3C) to select an initial or trial value for the bed shear stress.

Control is transferred to step 546 to determine friction factors from the Dodge and Metzner paper and the Nikuradse paper. All curves from these references are preferably coded as equations for use in a computer program. Control is transferred to step 547 and the parameter defined in Equation 2 is calculated. If the bed surface is hydrodynamically rough, then the friction factor obtained from Nikuradse at the appropriate relative roughness is used. If No, control is transferred to step 552. If the surface is hydrodynamically smooth, then the friction factor obtained from Dodge & Metzner's paper at an appropriate value of n is used (step 554). If the surface is in transition (No to step 552), the friction factor is determined by logarithmically interpolating between the two friction factors determined above.

Control is transferred to step 558 to calculate the bed shear stress from Eq. 1. Control is transferred to steps 559 and 560 to determine if it differs from the initial or trial value by more than a fixed small number. If Yes, control is transferred to step 561 to calculate a new value of bed shear stress as the arithmetic mean between the initial value and the value of step 558 and control is returned to step 546. If No, control is transferred to step 562.

After shear stress at the bed is determined for the applicable flow conditions and control is transferred to step 562, (FIG. 3D), shear velocity, and fluid viscosity are calculated. Control is transferred to step 564 to calculate the particle Reynolds number, defined as $$R^* = dV^* \rho_f / \mu \qquad \text{(Eq. 3)}$$

where d is particle size, V* is shear velocity as obtained with the bed shear stress calculated above, $\rho_f$ is fluid density, and $\mu$ is fluid viscosity at the shear rate corresponding to the shear stress calculated above.

Figure 4:
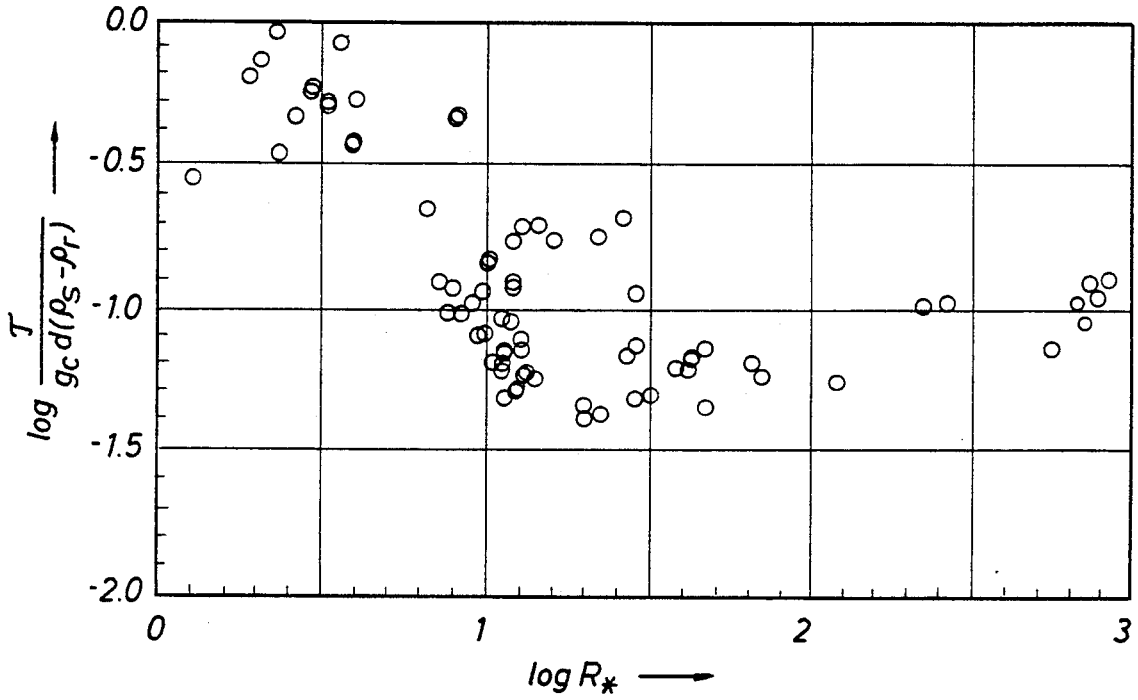
FIG. 4 is a plot of published experimental data showing a function of shear stress at the surface of a bed of particles vs. Particle Reynolds Number.

Control is transferred to step 566 to determine critical shear stress using a function representing the points shown in FIG. 4. The "critical" value of shear stress is defined by a curve passing through the points. We developed the curve of FIG. 4 for non-Newtonian fluids such as drilling fluids. Data from six different investigators, mostly for non-Newtonian fluids, which show equilibrium bed height and flow conditions were plotted and the results are shown in the figure. A set of equations defining segments of a curve representing the points was programmed in the computer for determining values of the critical shear stress as a function of Particle Reynold's Number. The symbols in the figure have the following meanings:

$\tau$ = shear stress at the surface of the bed
$g_c$ = gravity constant
d = size of particles in bed
$\rho_s$ = density of particles in bed
$\rho_f$ = density of fluid
R* = Particle Reynolds Number defined in Equation 3 above FIG. 4 is similar to a "Shields" curve for Newtonian fluids. (F. M. Henderson, *Open Channel Flow*, p. 413, McMillan Pub. Co., N.Y., 1966) Some uncertainty in the values shown on this type curve are expected for sedimentation phenomenon.

Control is transferred to step 568 to calculate the difference between the shear stress determined at the surface of the bed and the critical shear stress defined by the equations representing the points of FIG. 4 in step 566. Control is transferred to step 570 to compare the absolute value of the difference to a small number Δ. If the difference is larger than Δ, expressing the desired calculation accuracy, control is transferred to step 572 to determine if the difference is positive. If Yes, control is transferred to step 576 and H is incremented by a selected amount. If No, control is transferred to step 574 and H is decremented by a selected amount. Control is returned to step 502.

If No in step 570, then H is the equilibrium height of the free region over the cuttings bed, provided that a cuttings bed forms in the wellbore.

To verify that a cuttings bed will form in the wellbore, control is transferred to step 578 and the routine calculates settling velocity of cuttings in a quiescent fluid using, for example, information supplied by paper of R. E. Walker and T. M. Mayes, *Journal of Petroleum Technology*, July 1975, which is incorporated by reference herein. Control is transferred to step 580 to determine if the ratio between the settling velocity and the shear velocity is less than 0.04. If Yes, then a "wash load" condition exists and a bed of cuttings of the size particles assumed would not be expected. If No, the equilibrium value of H has been determined.

Figure 5:
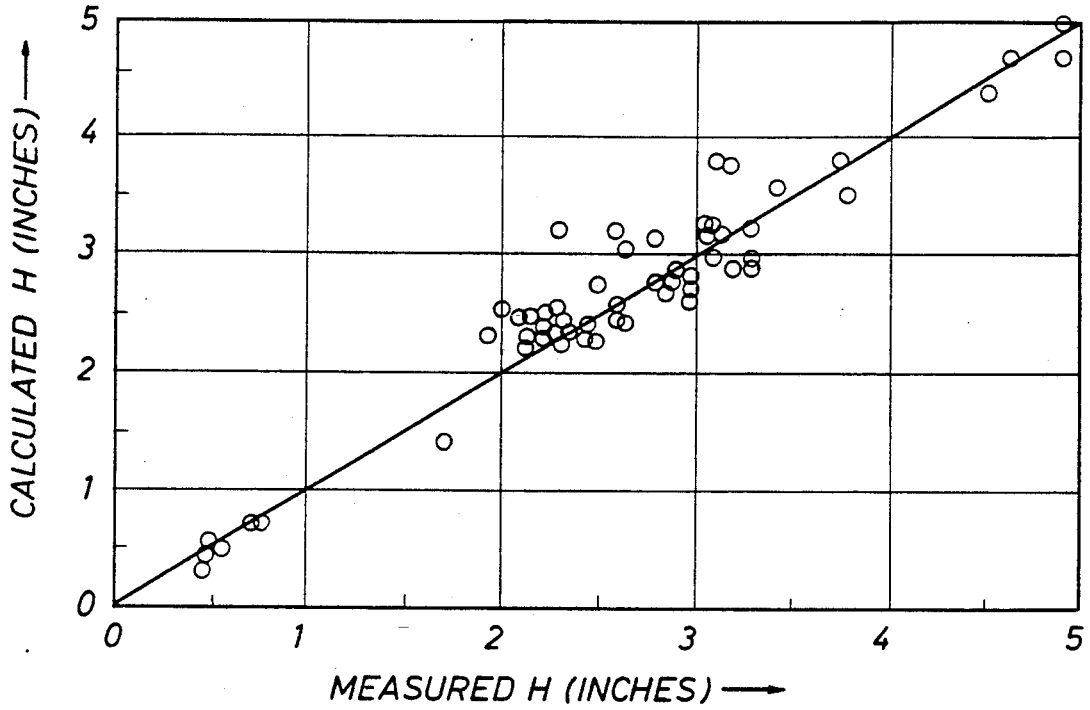
FIG. 5 is a plot of calculated and published measurements of distances open above beds of particles.

FIG. 5 shows calculated values of H compared with values of H reported in the literature from the same experiments in laboratory models used to develop FIG. 4. It can be seen that the agreement between the calculated and measured values of H is less than ½-inch for almost all the data points.

It is apparent that many modifications of the method to calculate the distance across the open area above the bed hereinabove set forth are possible for those skilled in the art. For example, other friction factor curves could be used, such as the Moody Diagram (F. M. Henderson, *Open Channel Flow*, p. 93, McMillan Pub. Co., N.Y., 1966). The detailed description of the method is given by way of example only, and the invention is limited only by the terms of the appended claims.

Critical Value of H to Avoid Pipe Sticking

In one embodiment of this invention, the value of H, determined as set out above, is compared with a "critical" value of H, which is based on experiments set out below.

Experience in drilling operations shows that pulling drill string out of the hole, whether for a full trip or for a wiper trip, is by far the operation that most frequently leads to stuck pipe. Therefore, an experimental program studied the process of pulling a simulated drill string from a hole in the presence of a cuttings bed. Results showed that when a larger diameter body, simulating a drill bit, is pulled across a bed of particles lying at the bottom of a high-angle hole, the bed deforms and flows around the larger diameter body and the body does not become stuck if the cuttings bed does not occupy too much of the hole. FIG. 6 illustrates this condition. In FIG. 6(*a*), the initial height of the bed is shown. After the larger diameter body moved across the bed, a wedge-shaped hill of cuttings formed under the body (FIG. 6(*c*)). A steady state condition was reached in which the hill of cuttings moved with the body over the bed (FIG. 6(*e*)) and the body did not become stuck.

When the cuttings bed was initially higher, as shown in FIG. 7(*a*), the wedge-shaped hill formed at the leading edge (FIG. 7(*c*)) grew in height until it occupied the entire cross-sectional area of the region that was initially open. Further pulling caused the hill to grow in length (FIG. 7(*e*)). A point was reached when the force required to pull farther became orders a magnitude larger than the force needed with the low initial height such as in FIG. 6. In other words, the body became effectively stuck in the hole.

Figure 8:
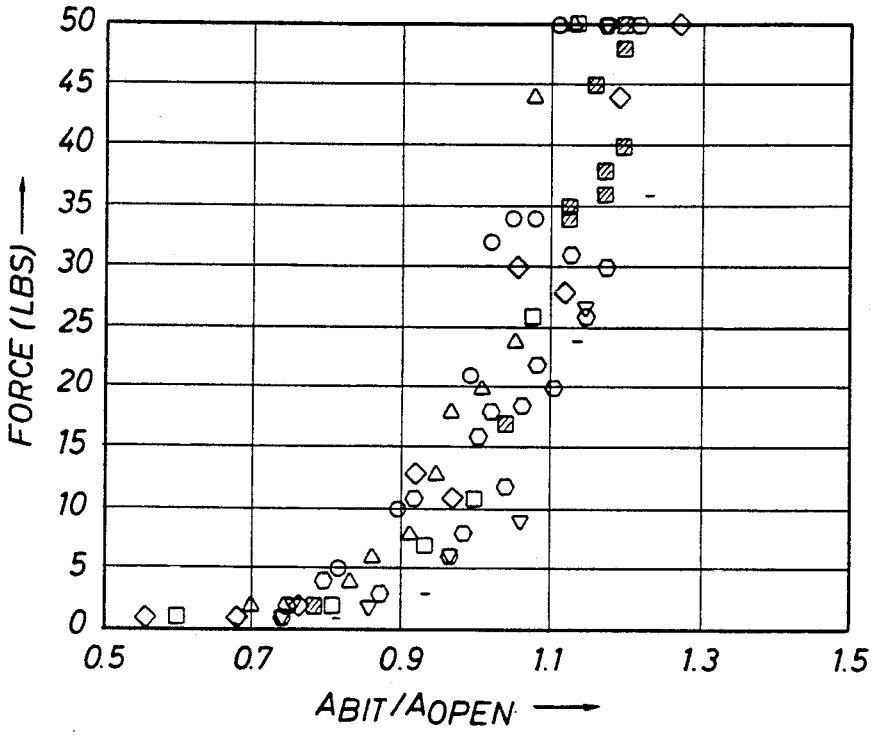
FIG. 8 is a plot of measurements of force required to move a simulated bit through a bed of cuttings as a function of areas of the bit and of the open region above the bed.

Experiments performed in horizontal pipes containing a bed of solid particles showed that whether a blunt body pulled over a bed of particles became stuck could be predicted by the ratio of the cross-sectional area of the blunt body (simulating the bit in drilling operations), $A_{bit}$, and the cross-sectional area originally open over the bed of cuttings, $A_{open}$. In these experiments, the element pulling the blunt body had negligible area. FIG. 8 shows the experimental results from a series of nine experiments with different sizes and shapes models, inclinations, and wet and dry sand. The sharp increase in the force when $A_{bit}$ divided by $A_{open}$ is about 1 provides an understanding of the process of pulling a blunt body such as a bit from a hole containing a bed of cuttings. There is a critical value of $A_{bit}$ divided by $A_{open}$. Above the critical value, the over-pull required to move the blunt body increases rapidly over a small increase in the value of the ratio of areas. From the value of H, defined in FIG. 2, $A_{open}$ can be calculated from well-known geometric relationships. To avoid sticking, the open cross-sectional area over the bed should be about equal to or greater than the solid cross-sectional area of the bit.

Since conditions of pulling a bit out of a wellbore cannot be precisely simulated in the laboratory, the critical value of $A_{bit}$ divided by $A_{open}$ may be somewhat different in the field from what is found in the laboratory. Also, since the pulling element (i.e., drill pipe) no longer has negligible area, the cross-sectional area of the drill pipe must be considered. The sum of the area above the bed, calculated from the value of H, and the area of the drill pipe, compared with the cross-sectional area of the bit, will determine if sticking will occur. The ratio of $A_{bit}$ to $A_{open}$ plus $A_{drill\ pipe}$ is thus a key factor in determining whether the cuttings bed is likely to lead to sticking of the drill string.

Figure 9:
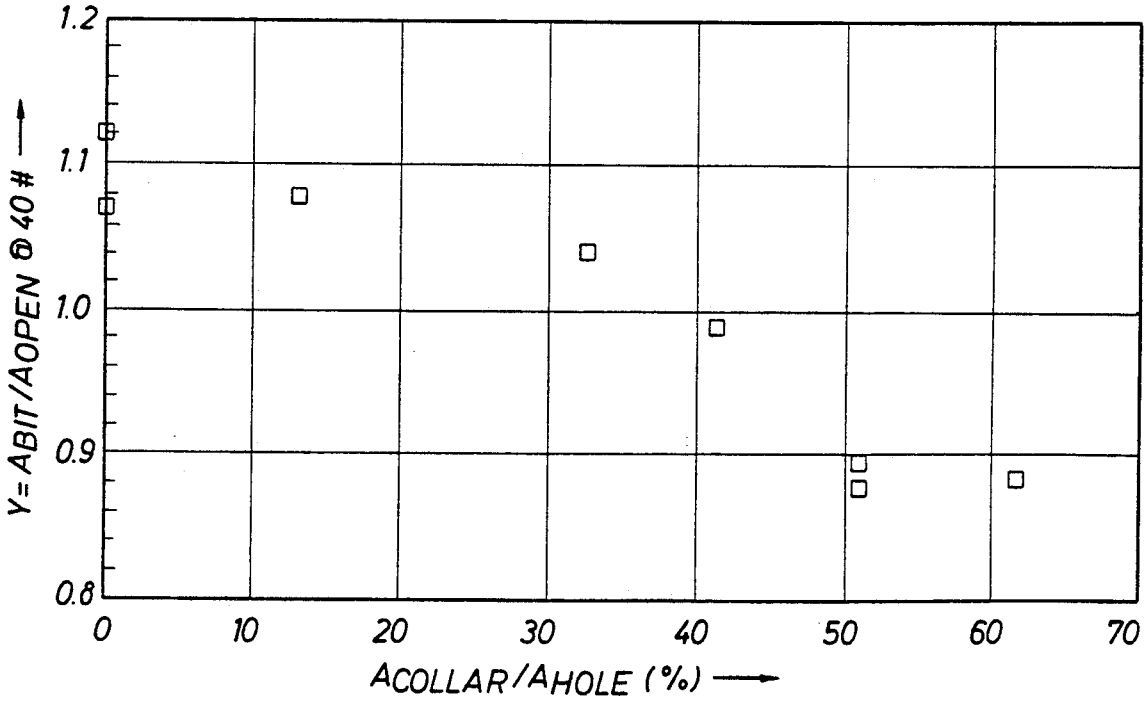
FIG. 9 is a plot of measurements of the effect of simulated collar size on force to move a simulated bit attached thereto.

Experiments also showed that the value of the ratio $A_{bit}$ divided by $A_{open}$ at which "overpulls" (discussed below) became high was affected somewhat by the diameter of drill collars above the bit (see FIG. 1), but not appreciably by the length of the collars. Larger diameter simulated collars slightly increased the tendency toward sticking when every other variable was unchanged. Although a change in collar diameter did not necessarily have an effect large enough to justify changing collar size to reduce the risk of drill pipe sticking, the effect of collar size was incorporated into the method of a preferred embodiment of this invention. FIG. 9 shows the effect of the area of collars compared with the area of the hole on the ratio of $A_{bit}$ to $A_{open}$ at a pulling force of 40 pounds. Approximately a 10% variation in the ratio was observed with different collar sizes.

Definition of a critical value of H to achieve a small risk of drill string sticking, called $H_{critical}$, is now possible. $H_{critical}$ may be taken to be equal to the value of H for which the ratio $A_{bit}$ to $A_{open}$ plus $A_{drill\ pipe}$ has the value of one. Alternatively, $H_{critical}$ may be taken to be equal to the value of H for which the ratio $A_{bit}$ to $A_{open}$ plus $A_{drill\ pipe}$ has the value obtained by reading the ordinate of FIG. 9 at the appropriate $A_{collar}$ to $A_{hole}$ ratio. The corresponding value of $H_{critical}$ can be calculated using well-known geometric formulas. The comparison of H calculated by the method of this invention and $H_{critical}$ provides a tool to predict and prevent hole cleaning problems in highly deviated wells. The ratio $H/H_{critical}$ is denoted herein the "Hole Cleaning Ratio," or HCR. Typically, it is recommended that in drilling operations the value of HCR be equal to or greater than 1.1. In some cases, however, in which previous drilling in the region shows problems are less than average, or pumps are limited, it may be recommended that HCR be equal to or greater than 1.0, or even 0.9. In other words, a predetermined value in the vicinity of 1.0 is used for HCR.

The discoveries made from the laboratory experiments also lead to selection of bits which will decrease the probability of pipe sticking. Such bits have lower ratio between bit cross-sectional area and nominal hole size drilled by the bit, such that more area is available around the bit for flow of cuttings around the bit as the drill string is moved longitudinally in the wellbore. Surveys of commonly available bits used in drilling showed this ratio varying from about 0.60 to about 0.92 for different designs of bits. The importance of lower bit cross-sectional area in a given size hole also indicates advantages of increasing the use of hole openers or under-reamers to decrease the risk of pipe sticking when drilling large holes in highly deviated wells. The benefits of such devices must be balanced against potential mechanical troubles from their use.

Correlation of HCR with Field Results

Application of the above methods of this invention to field results shows that the ratio of calculated H to $H_{critical}$, which is defined herein as HCR, clearly discriminates trouble-free from troublesome drilling. H is calculated by the method described above. $H_{critical}$ is the value of H for which the area $A_{bit}$ divided by $A_{open}$ plus $A_{drill\ pipe}$ has the value approximately equal to 1, but is more precisely obtained by reading the ordinate of FIG. 9 at the appropriate $A_{collar}$ to $A_{hole}$ ratio.

Data bases containing drilling information are commonly compiled from "morning reports" and other information regarding wells drilled. Morning reports contain field data on bit size, bit type and style, flow rate, mud rheology, mud weight and other measured drilling parameters. From these data, the procedures outlined above in the method of this invention can be used to calculate H, $H_{critical}$ and HCR. The value of HCR can be compared with the frequency of problems while drilling high angle wells.

A data base from wells drilled in the North Sea was used. All data from holes with bit sizes less than 10½" were excluded, because the method of this invention is not applicable unless hole size is large compared with drill pipe diameter. (The next smallest size bit in the data base was 8½-inches, which is too small for the methods of this invention with the drill pipe sizes used.) Drilling data and wellbore inclination less than or equal to 50° were also excluded, since the method is applicable only to hole angles greater than about 50 degrees to vertical. Wells in which the pipe was differentially stuck by the pressure difference between the hydrostatic pressure in the mud and the pore pressure in the rock drilled were also excluded. About 50 wells were left in the data base and approximately 140 drilling days. The calculations were made for cuttings sizes between 0.01 and 0.5 inches diameter and the most unfavorable (smallest) value of H was used. Rheological properties of the drilling fluid were expressed as yield point, plastic viscosity and 10-second gel. Since, in general, the shear rate on the cuttings bed at equilibrium bed height was found to be close to the 100 to 200 Fann viscometer RPM range, the values of n and K were taken as derived from the 100 and 200 RPM dial readings. A three-parameter yield-power-law rheogram was used with 10-second gel assumed to be equal to the 6 RPM reading. The cross-sectional area for commonly used bits was used.

Figure 10:
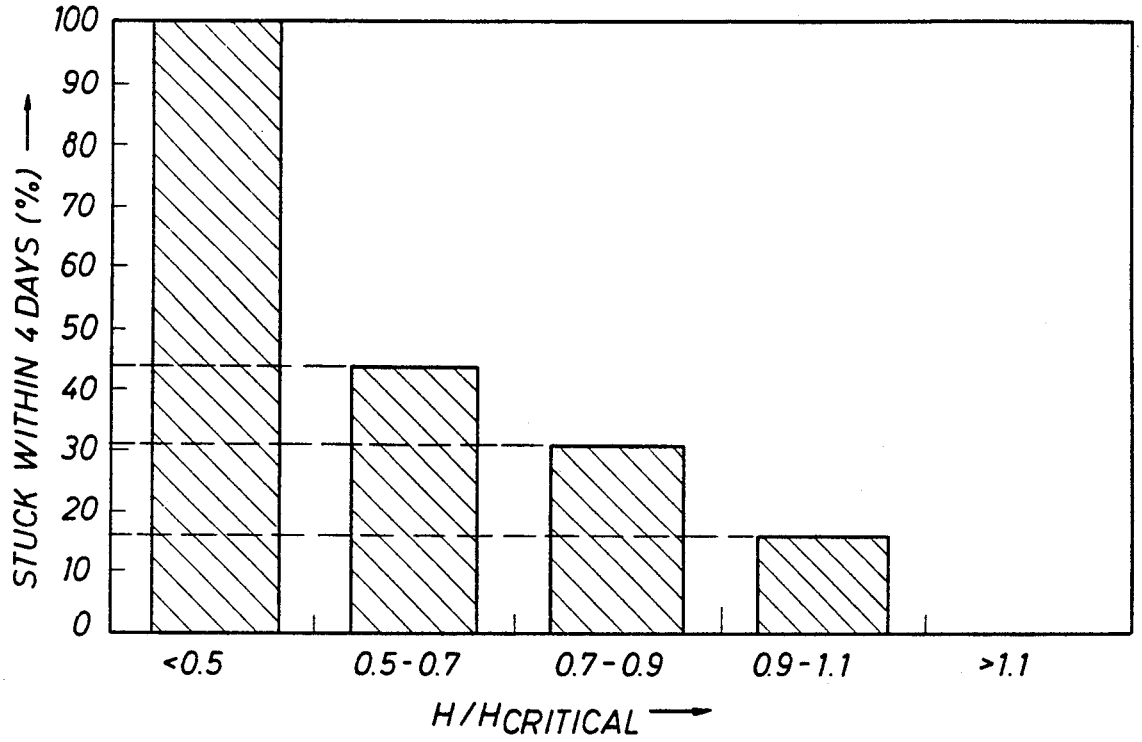
FIG. 10 shows the frequency of stuck drill pipe as a function of Hole-Cleaning Ratio.

FIG. 10 shows the frequency of stuck pipe incidents in these North Sea wells within 4 days as a function of the calculated HCR. The dependency of stuck pipe frequency on HCR is very apparent. The method of this invention can be applied to generate such frequency curves for any area of drilling using data from only that specific area or, alternatively, it can be applied to generalized data including wells from the entire data base.

Figure 11:
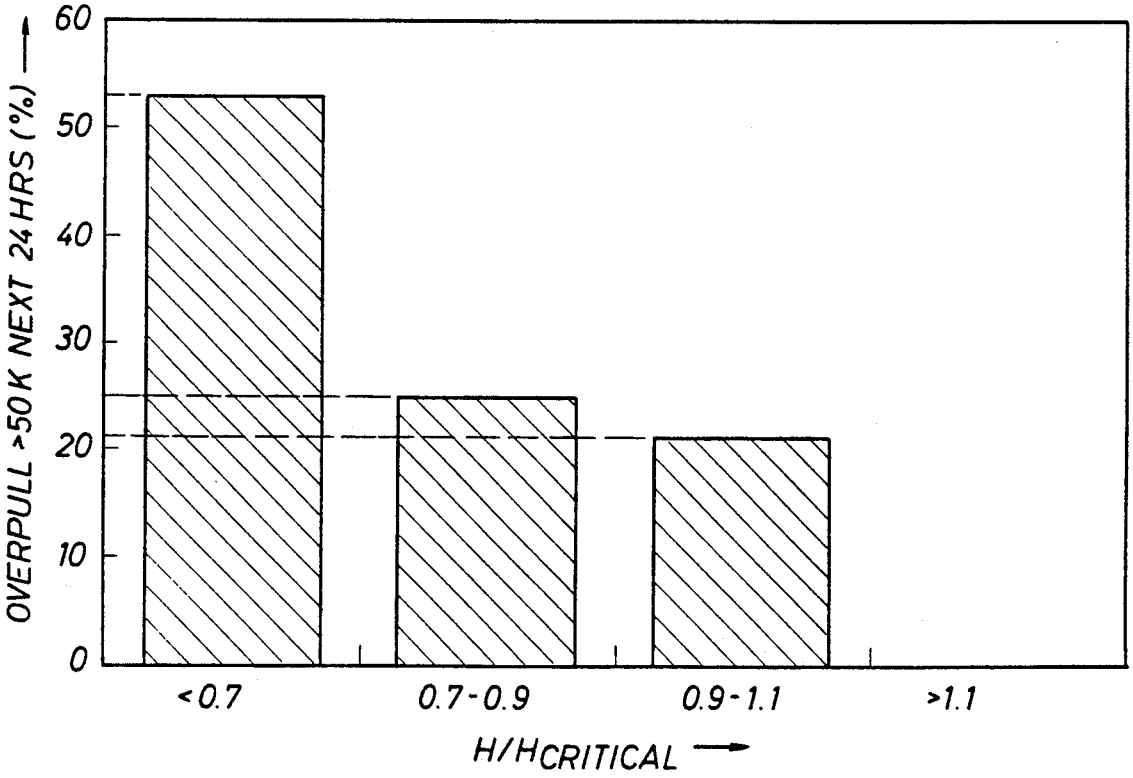
FIG. 11 shows the frequency of high overpull as a function of Hole-Cleaning Ratio.

Sometimes measurements of abnormally high forces required to pull the drill string from the hole are provided. The terms "overpull" is often used to describe this measured force. The relation of overpull while pulling out of the hole to HCR was examined for 10 wells in which detailed overpull data were available (in the Gulf of Mexico, the Bass Strait off Australia and the Norwegian North Sea). A good correlation was found between measured overpull and HCR calculated by the method of this invention. FIG. 11 summarizes the frequency of events in which overpull in excess of 50,000 pounds was measured within the next 24 hours while pulling out of the hole as a function of HCR in these wells. Drilling at a HCR above 1.1 never produced high overpull. Drilling at a HCR below approximately 0.7 meant that high overpull had a frequency of occurrence above 50 per cent. The data demonstrate the method of this invention to be generally valid to characterize hole cleaning during drilling and its effect on drag on the drill pipe. Calibration of the method using similar wells in the same drilling area and detailed data from these wells would increase the accuracy of the method for analyzing and predicting the probability of troublesome drilling conditions in a particular well in that area as it is being drilled or for planning the equipment and materials needed for drilling wells in the future.

The method of this invention can also be applied in a similar way to predict other drilling problems associated with insufficient hole cleaning in high-angle wells. Frequency of difficulty in running casing in the hole as a function of HCR when drilling of the well reached total depth can be correlated to produce a graph such as shown in FIGS. 10 and 11, for example.

EXAMPLE 1

The methods of this invention were applied to hindcast the results of drilling two wells in an area and to determine if incentives existed for reducing the height of the cuttings bed in wells to be drilled in the future in the same area.

In these two wells, angle was built to about 60 to 70 degrees from vertical in the 17½-inch surface hole and was held constant in the 12¼-inch intermediate hole, where most of the drilling time was spent. The HCR was calculated for both intermediate holes in these two wells as a function of time. In one well, HCR averaged 0.97 and in the other well HCR averaged 0.82. Backreaming and pumping out of hole were performed for a tripping length over six times greater in the well with the lower HCR. The time spent washing and reaming was over four times as great in the hole with the lower HCR. A detailed day-by-day analysis of data shown on morning reports also showed a good correlation between low HCR and increased overpull required to move the drill pipe.

Figure 12:
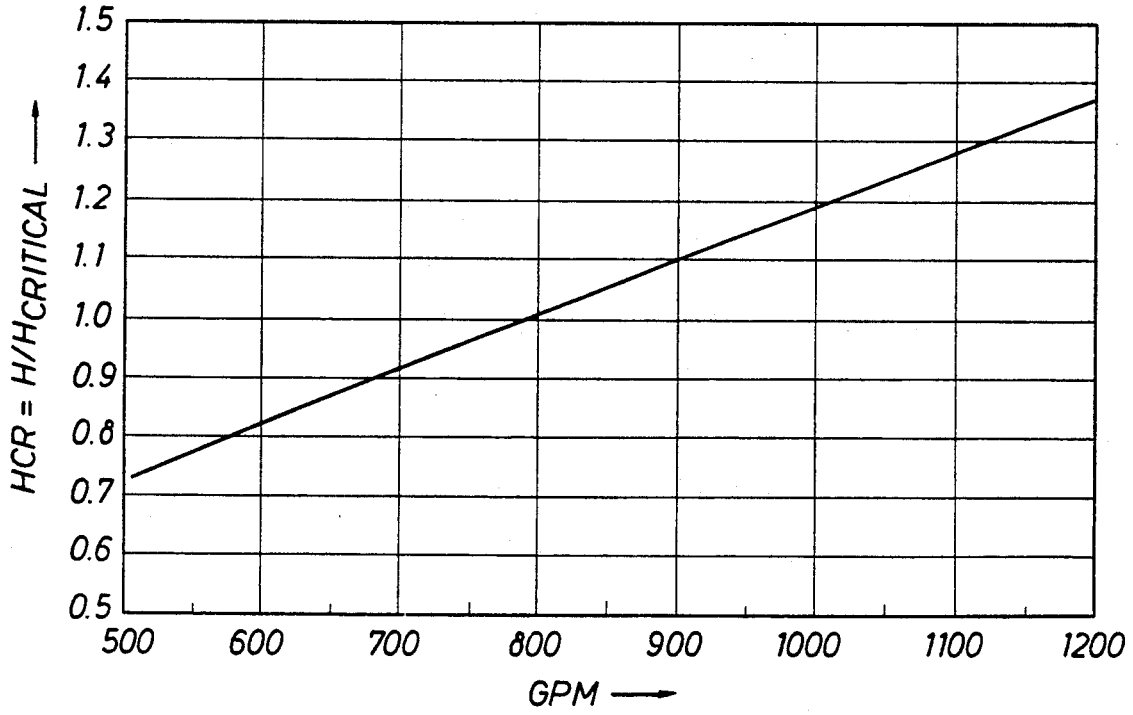
FIG. 12 shows calculated Hole-Cleaning Ratio as a function of flow rate of drilling fluid in the well of Example 1.

Design recommendations were made to minimize hole cleaning problems in future wells to be drilled in the area. A range of variables was used in calculations as described above to achieve a HCR of 1.1. The variables were flowrate, mud weight, mud rheology, bit type, drill collar diameter, and cuttings size. FIG. 12 is an example of the effect of flowrate of the drilling fluid on HCR for conditions as follows: bit-12¼-inch "HYCALOG DS 40;" drill collar diameter 7¾-inch; drill pipe diameter 5-inch; cuttings 0,001-inch to 0.1-inch, specific gravity 2.5; mud weight 9 pounds per gallon, mud plastic viscosity 15 cp, yield point 13 pounds per 100 square feet, and 10-second gel 5 pounds per 100 square feet. This figure shows the well-planner that a flow rate of 900 gallons per minute is needed to obtain the desired HCR of 1.1. It was recommended that pumping equipment provided for a future well have sufficient capacity to achieve this flow rate.

EXAMPLE 2

Data from high-angle wells drilled in a specific geologic province are gathered showing a variety of drilling problems, including high torque and drag, drill string sticking, difficulty in running casing, loss of returns and other problems which could be caused by accumulation of cuttings in the wellbore. Data showing drilling variables as a function of time during the drilling of the individual wells are gathered, these data including drilling fluid rheology and density, bit type and size, drill collar diameter and length, circulation rate of drilling fluid, cuttings size and cuttings density. In these same wells, the dimension above the bed of cuttings in the hole, H, is calculated, the value of $H_{critical}$ is calculated for each bit and bottom-hole assembly, and the Hole-Cleaning Ratio is calculated as a function of depth and time during the drilling of the wells. Occurrences of drilling problems are correlated with the calculations of H and HCR in each well. Probability graphs or charts are prepared for successive wells and groups of wells. Data from wells in other geologic provinces are compared with data from the province of interest. Risk of drilling problems is better defined as more data are available.

Calculations of HCR for various combinations of variables are performed to select the optimum combination of drilling variables to drill the next well at minimum cost, considering the risk of drill string sticking, additional drilling time and cost required for various drilling procedures (such as backreaming and washing and reaming), additional time to run casing and other trouble costs required at lower levels of HCR. The cost of reducing the risk of modifying the different variables is estimated. Drilling of the well is planned with conditions predicted to minimize costs. Drilling variables are modified during the drilling process as data become available to maintain conditions most closely approximating minimum costs and within practical and achievable limits.

It is apparent that many modifications and variations of this invention as hereinabove set forth may be made without departing from the spirit and scope thereof. The specific embodiments described are given by way of example only and the invention is limited only by the terms of the appended claims.

What is claimed is:

1. A method of calculating the equilibrium distance, H, across an open region above a bed of solids in a high-angle wellbore comprising:

selecting values of drilling variables, the drilling variables comprising drilling fluid rheology, drilling fluid density, flow rate of drilling fluid, size of cuttings and density of cuttings;

assuming a value of the dimension, H;

calculating a hydraulic radius and relative roughness of the bed surface;

calculating a generalized Reynolds number for flow in the open region above the bed to determine flow regime;

determining a friction factor dependent on the generalized Reynolds number and flow regime;

using the friction factor to calculate the shear stress at the surface of the bed;

calculating a particle Reynolds Number for a shear velocity corresponding to the shear stress at the surface of the bed;

determining a critical shear stress for erosion of the bed corresponding to the calculated particle Reynolds Number and comparing the shear stress at the surface of the bed to the critical shear stress; and iterating on the value of H until the shear stress at the surface of the bed and the critical shear stress for erosion are within a selected differential value to determine the equilibrium distance across the open region above the bed of solids.

2. The method of claim 1 further comprising the step of changing the value of a drilling variable to modify the equilibrium distance of the open region above the bed of solids.

3. A method for decreasing the probability of sticking a drill string having a bit when drilling a hole at an angle to vertical of more than about 50 degrees comprising:

using the size and design of the bit, determining the solid cross-sectional area of the bit;

calculating the area of open region of the hole above a bed of cuttings in the hole;

selecting drilling variables such that the calculated cross-sectional area of the open region of the hole above the bed of solids plus the cross-sectional area of the drill pipe is greater than about 0.9 times the solid cross-sectional area of the bit; and drilling the hole utilizing the selected drilling variables.

4. The method of claim 3 further comprising the step of selecting the bit to have a solid cross-sectional area less than the calculated cross-sectional area of the open region in the hole with selected drilling variables plus the cross-sectional area of the drill pipe before drilling the hole.

5. The method of claim 3 wherein the calculations are performed and the drilling variables are adjusted during the drilling of the well.

6. The method of claim 3 wherein the calculation of the area of open region above the bed of cuttings comprises:

assuming a value of the distance across the open region, H;

calculating a hydraulic radius and relative roughness of the bed surface;

calculating a generalized Reynolds number for flow in the open region above the bed to determine flow regime;

looking up a friction factor dependent on the generalized Reynolds Number and flow regime determined;

using the friction factor to calculate shear stress at the surface of the bed;

calculating a particle Reynolds Number for the shear velocity corresponding to the shear stress at the surface of the bed;

determining a critical shear stress for erosion of the bed corresponding to the calculated particle Reynolds Number and comparing the shear stress at the surface of the bed to the critical shear stress;

iterating on the value of H until the shear stress at the surface of the bed and the critical shear stress for erosion are within a selected differential value to determine the equilibrium distance across the open region above the bed of solids; and calculating the cross-sectional area of the open region using the equilibrium distance and the hole diameter.

7. A method for predicting a drilling problem in a high-angle well drilled with a drill pipe and a drill bit comprising:

using data on drilling variables and drilling conditions in the well, calculating the cross-sectional area of an open region above a bed of cuttings in the well;

determining the solid cross-sectional area of the drill pipe and drill bit used in the well;

calculating the ratio of the sum of the cross-sectional areas of the open region plus the drill pipe to the cross-sectional area of the drill bit; and comparing the ratio to a pre- determined number.

8. The method of claim 7 wherein the pre-determined number is modified by the ratio of the cross-sectional areas of the drill collars and the hole.

9. A method for predicting the probability of a drilling problem in a high-angle well of interest comprising:

calculating the area of an open region above a bed of solids which existed at a time prior to the occurrence of the drilling problem in a prior-drilled well or wells;

determining the cross-sectional area of bits and drill pipe used in drilling the prior-drilled well or wells and calculating the ratios of cross-sectional areas of the bit and the open region plus the drill pipe at a plurality of times during drilling of the prior-drilled well or wells to determine a Hole-Cleaning Ratio at the times;

determining the frequency of occurrence of the drilling problem within a pre-determined time after the time for which the Hole-Cleaning Ratio is determined in the prior-drilled well or wells;

determining a relationship between the Hole-Cleaning Ratio and the frequency of occurrences of the drilling problem within a pre-determined time after the time for which the Hole-Cleaning Ratios are determined in the prior-drilled well or wells;

determining the Hole-Cleaning Ratio in the well of interest; and applying the relationship to predict probability of the drilling problem occurring in the well of interest within the predetermined time.

10. The method of claim 9 wherein the drilling problem is stuck drill string.

11. The method of claim 9 wherein the drilling problem is high overpull required for moving the drill pipe.

12. The method of claim 11 wherein the drilling problem is related to running casing in the well.

* * * * *